US006325157B1

(12) United States Patent
Arakawa et al.

(10) Patent No.: US 6,325,157 B1
(45) Date of Patent: Dec. 4, 2001

(54) STRIKING TOOL WITH AN IMPROVED COOLING MECHANISM

(75) Inventors: Takuo Arakawa, Hekinan; Koki Hyodo, Nishio, both of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/442,815

(22) Filed: Nov. 18, 1999

(30) Foreign Application Priority Data

Nov. 19, 1998 (JP) ..... 10-329887

(51) Int. Cl.[7] ..... B25D 9/00

(52) U.S. Cl. ..... 173/201; 173/117; 173/171; 173/217

(58) Field of Search ..... 173/117, 217, 173/201, 205, 104, 109, 110, 171; 310/50, 47

(56) References Cited

U.S. PATENT DOCUMENTS 3,517,755 * 6/1970 Badcock ..... 173/117
3,718,193 2/1973 Wanner ..... 173/117
3,926,266 * 12/1975 Dorgnon ..... 173/110
4,476,941 * 10/1984 Buck et al. ..... 173/117
4,567,951 * 2/1986 Fehrle et al. ..... 173/117
5,052,497 * 10/1991 Houben et al. ..... 173/109
5,099,160 * 3/1992 Strozel et al. ..... 310/47
6,123,158 * 9/2000 Steffen ..... 173/217
6,127,751 * 10/2000 Kristen et al. ..... 310/50

FOREIGN PATENT DOCUMENTS 57-181585 5/1981 (JP) .

* cited by examiner

*Primary Examiner*—Scott A. Smith
(74) *Attorney, Agent, or Firm*—Foley, Hoag & Eliot LLP

(57) ABSTRACT

A hammer drill 1 includes a barrel 2 containing a striking mechanism. The drill further includes a motor 4 with a motor shaft 6 encased in a motor accommodating chamber 19 which has an upper opening at which a baffle plate 20 is disposed. The baffle plate 20 includes a bottom portion 21 and a partition 22. The baffle plate 20 further includes a flange 23 that extends radially around the upper edge of the partition 22 except toward the front of the partition 22 with the outer edge of the flange 23 reaching the inner surface of the motor housing 3. Additionally, a generally horizontal slot 24 is formed at the front peripheral surface of the bottom portion 21 of the baffle plate 20. Moreover, a plurality of air inlets 27 are provided at the rear end of a housing handle 5 of the drill 1, whereas a plurality of air outlets 29 are provided at the bottom of the motor housing 3. When air is drawn inside the hammer drill 1 by rotation of a cooling fan 28 fitted on the motor shaft 6, the air travels through the motor 4 upstream of the motor 4 after flowing through the barrel 2 along an extension air passage 30, thus cooling the striking mechanism.

12 Claims, 3 Drawing Sheets

STRIKING TOOL WITH AN IMPROVED COOLING MECHANISM

This application claims priority on Japanese Patent Application No. 10-329887 filed on Nov. 19, 1998, the contents of which are incorporated herein by reference.

BACKGROUND OF THE INVENTION

1. Field of the Invention

The present invention relates to striking tools, such as hammer drills and electric power hammer. More particularly, the present invention relates to a striking tool, such as those described above, which cools the motor incorporated therein by generating an airflow through the motor housing.

2. Description of the Related Art

A typical striking tool includes a main housing which contains a striking mechanism with a tool bit attached to the top end thereof and a motor housing which contains a motor and which is connected to a rear portion of the main housing. When the tool is activated, the motor operates the striking mechanism to cause the tool bit to repeatedly strike a workpiece. As the motor generates heat during operation, a cooling fan is generally provided in such a striking tool. Japan Published Unexamined Utility Model Application No. 57-181586 discloses one such tool, in which a cooling fan is fitted around the motor shaft such that rotation of the motor creates an airflow through the motor housing, thus cooling the motor during operation.

Although a conventional arrangement for cooling the motor such as the foregoing serves its purpose, it is not free from certain defects. For example, the airflow created by the fan in the foregoing disclosure does not reach the main housing, passing through the motor housing only. Therefore, heat generated from the cylinder and other elements of the striking mechanism during operation may significantly raise the temperature of the main housing. At times, the operator may find it uncomfortable to hold the tool due to the heat conducted from the striking mechanism.

As a corrective measure, one or more air inlets may be provided on a side portion of the main housing so as to pass air through the main housing. Problems inherent in this arrangement include the ease with which dust or other foreign matter is drawn into the main housing and the adverse effects such foreign matter has on the operation of the striking mechanism when the tool is used with the attached bit pointed upward. While these problems could be solved if the outlets of cooling air are relocated to a side portion of the main housing, other problems are created. For example, unpleasant air would blow against the operator's hand, thus irritating the operator.

SUMMARY OF THE INVENTION

In view of the above-identified problems, an important object of the present invention is to provide a striking tool which can cool the main housing as well as the motor housing while protecting the internal mechanism from dust or any other foreign matter.

Another object of the present invention is to provide a striking tool which can cool the main housing as well as the motor housing while ensuring comfortable use of the tool.

The above objects and other related objects are realized by the invention, which provides a power-driven striking tool having front and rear portions. The striking tool comprises: a main housing containing a striking mechanism for transmitting hammer blows to a tool bit attached to the front portion of the tool; and a motor housing connected behind the main housing. The motor housing contains a motor having a motor shaft on which a fan is provided. When rotated by the motor, the fan creates an airflow through the motor housing. The striking tool further comprises: at least one air inlet provided in the rear of the main housing for admitting the airflow; a closing member extending in front and rear directions for isolating the motor from the main housing; and an air gate configured to allow the airflow to enter the motor housing after passing over a front end of the closing member and through at least a portion of the main housing, thus cooling the striking mechanism.

According to the invention, both the striking mechanism and the motor are cooled by airflow drawn by the motor due to the structure for isolating the motor from the main housing as well as the position of the air inlets. This allows the operator to hold the striking tool without feeling the discomfort caused by excessive heat, thus enhancing the operability of the tool.

According to one aspect of the present invention, the closing structure includes the air gate. In addition, the closing structure can be, for example, a baffle plate including a bottom portion which pneumatically separates the motor housing from the main housing except at the air gate, with the air gate provided in a front end of the bottom portion. In addition, the baffle plate can further include a flange along which the airflow is guided into the main housing toward the air gate.

According to another aspect of the present invention, the motor housing is connected to the main housing such that an axis of the motor housing is oriented at right angles to an axis of the main housing.

According to still another aspect of the present invention, the motor housing contains a substantially cylindrical inner housing for containing the motor, with the inner housing having a substantially circular opening in which the bottom portion of the baffle plate is fitted to close the opening and further the inner housing having a peripheral wall.

According to yet another aspect of the present invention, the flange includes a front end which is distal to the at least one air inlet and proximal to the front portion of the striking tool. In addition, the flange can further include a rear end proximal to the at least one air inlet and distal to the front portion of the striking tool, with the front end being located forward of the air gate such that external air drawn into the tool through the at least one air inlet travels over the flange and around the front end of the baffle plate and enters the motor housing at the air gate.

According to one feature of the present invention, the fan is fitted on the motor shaft in close proximity to a bottom of the motor housing. Additionally, at least one air outlet can be provided in the bottom of the motor housing, such that rotation of the motor draws in external air though the at least one air inlet and discharges the air through the at least one air outlet via the main housing and the motor housing.

According to another feature of the present invention, the inner housing is located intermediately between the front and rear ends of the flange such that the airflow is oriented back toward the at least one inlet as the airflow enters the inner housing.

According to still another feature of the present invention, the striking tool further comprises a handle housing provided in the rear of the main housing and the motor housing, with the at least one air inlet provided in the handle housing directly in the rear of the main housing.

According to yet another feature of the present invention, the baffle plate further includes a recess in which a portion of the striking mechanism is fitted.

According to one practice of the present invention, the air gate is a circular slot concentric with the peripheral wall of the inner housing.

According to another practice of the present invention, the baffle plate further includes an inclined plate extending from a lower edge of the circular slot and reaches the motor housing so as to guide the airflow into the inner housing.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment according to the present invention will be described hereinafter with deference to the attached drawings.

Figure 1:
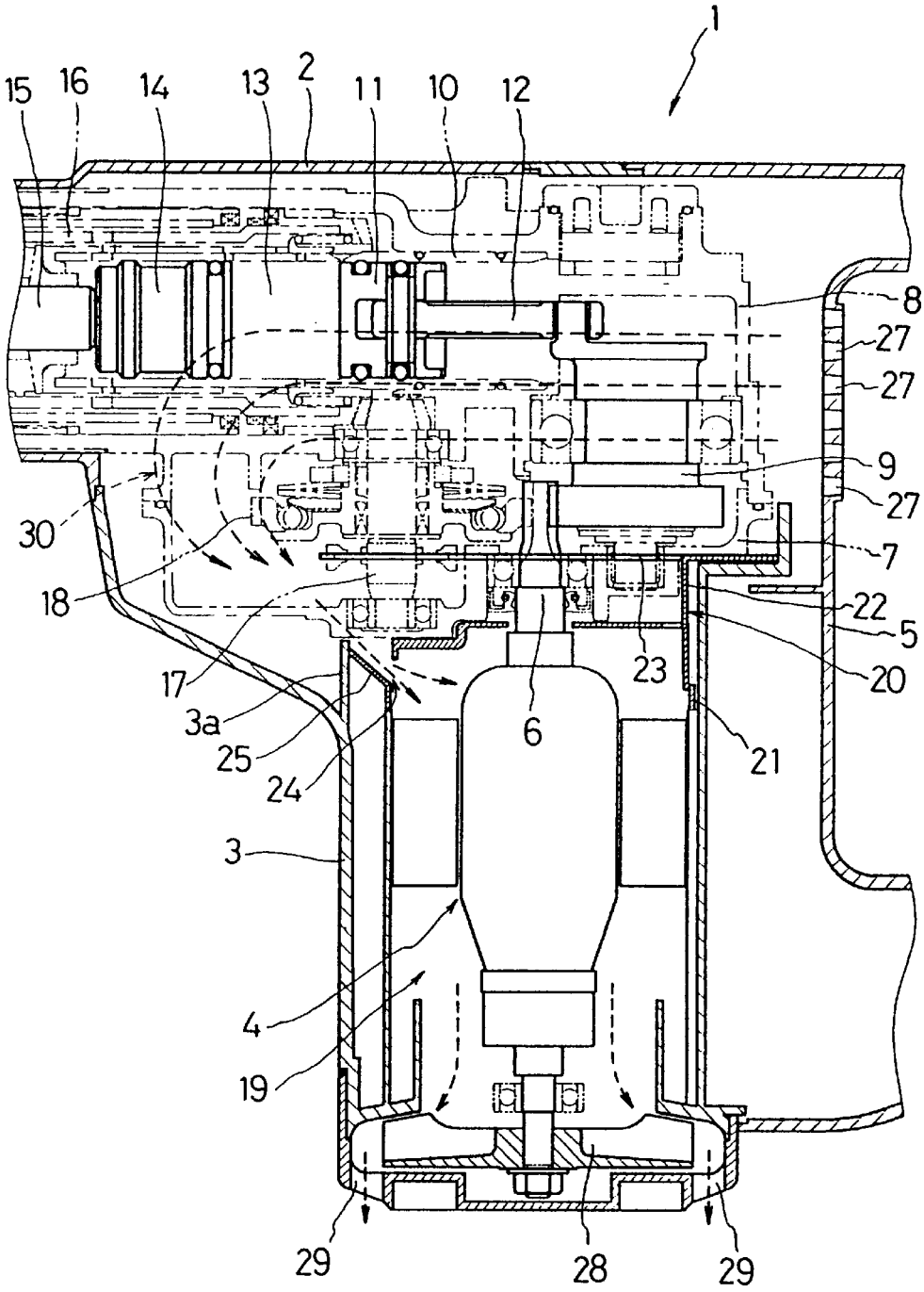
FIG. 1 is a partial cross section of an essential part of a power-driven hammer drill 1 in accordance with the present invention.

FIG. 1 is a partial cross section of an essential part of a power-driven hammer drill 1 in accordance with the present invention. The hammer drill 1 is encased within a main housing or barrel 2 which contains striking and rotary mechanisms and a motor housing 3 which contains a motor 4 and is connected to the barrel 2 at a right angle. Additionally, a handle housing 5 is attached to the rear end portions (to the right in FIG. 1) of the barrel 2 and the motor housing 3. The motor 4 is provided with a motor shaft 6 which protrudes into a crank housing 7 and a gear housing 8 assembled within the barrel 2 and the motor housing 3. The motor shaft 6 engages a crank shaft 9 supported by the gear housing 8. The crank shaft 9 is connected by means of a connecting rod 12 to a piston 11 in a cylinder 10 secured in the gear housing 8 such that the rotation of the crank shaft 9 causes the piston 11 to reciprocate in the cylinder 10. Additionally provided in the cylinder 10 are an air chamber 13 in front of the cylinder, a reciprocable striking element 14 in front of the air chamber, and another reciprocable intermediate element 15 in front of the striking element 14. When power to the tool 1 is turned on, the resulting reciprocating motion of the piston 11 causes the striking element 14 to repeatedly strike the rear end of the intermediate element 15, thus transmitting hammer blows to a tool bit (not shown) disposed in front of the intermediate element 15 where the bit is gripped by a tool holder 16. Reference numeral 17 designates an intermediate shaft which engages the motor shaft 6 for transmitting rotation of the motor 4 to the tool holder 16 via a gear 18 rotatably fitted on the intermediate shaft 17. The hammer drill 1 is additionally provided with a change-over lever (not shown) for operating the gear 18 so as to allow or prevent transmission of rotation of the motor 4 to the tool holder 16.

Figure 2:
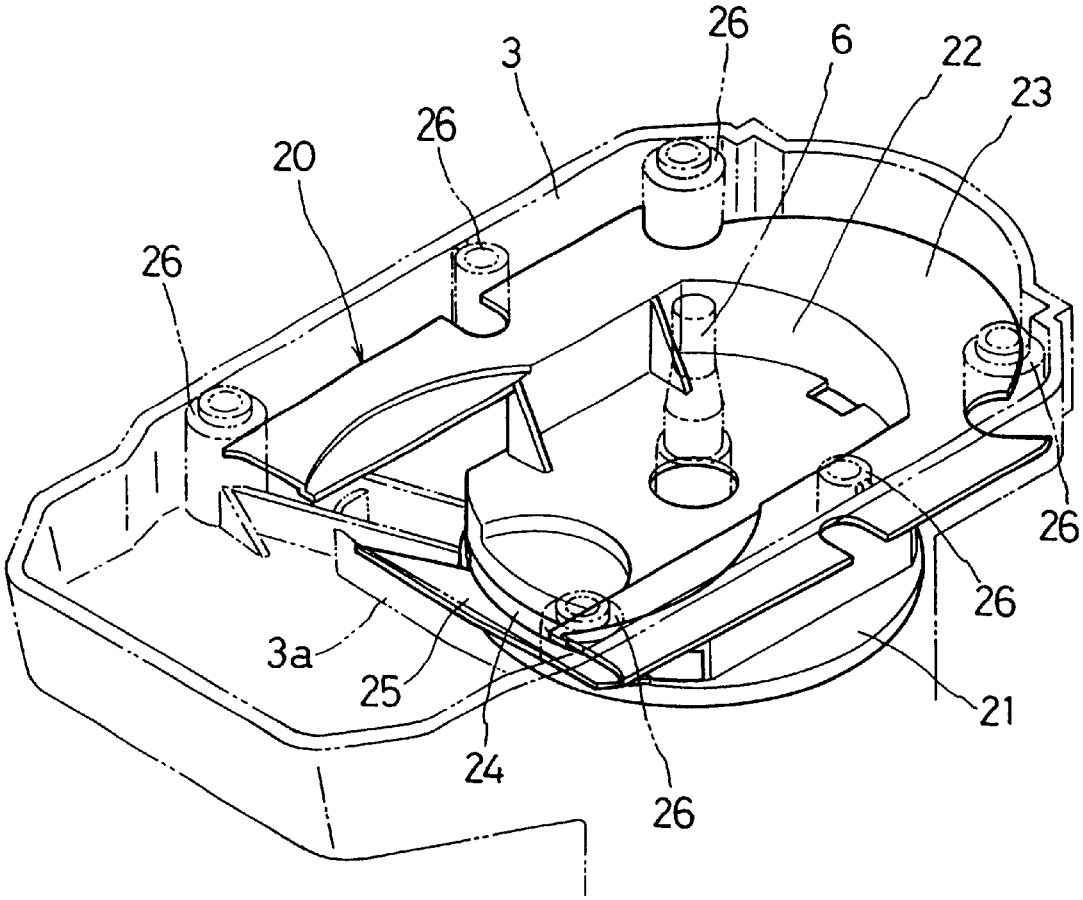
FIG. 2 is a perspective view of a baffle plate fitted in the motor housing of the power-driven hammer of FIG. 1.
Figure 3:
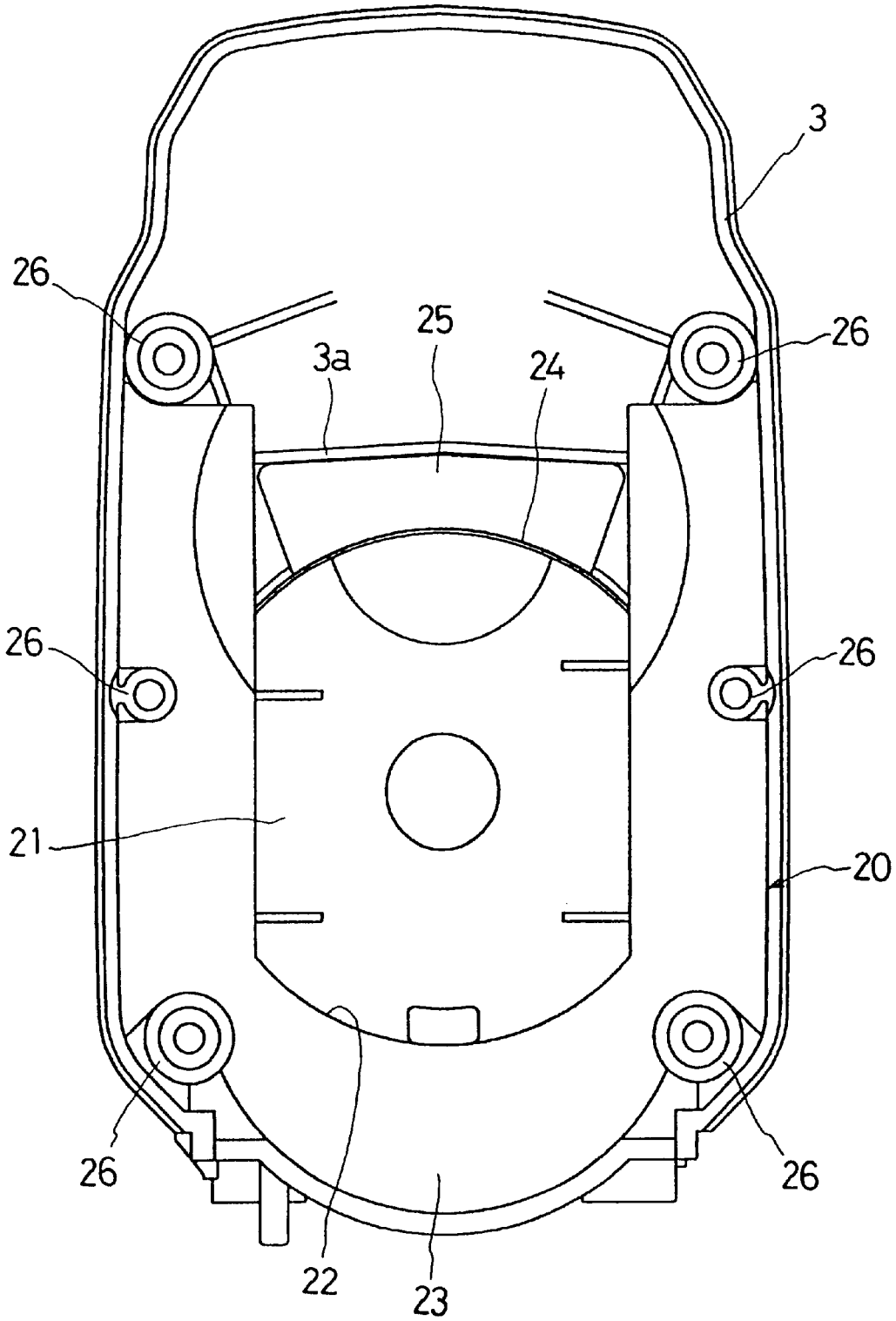
FIG. 3 is a plan view of the baffle plate fitted in the motor housing of the power-driven hammer of FIG. 1.

Still referring to FIG. 1, the motor housing 3 contains a cylindrical motor accommodating chamber 19 that in turn contains the motor 4 and has an opening where the motor housing 3 is coupled to the barrel 2. A baffle plate 20 is disposed at the opening of the motor accommodating chamber 19 so as to close the chamber 19 at the opening. As also shown in FIG. 2, the baffle plate 20 includes a dish-shaped bottom portion 21 which closes the opening of the chamber 19. The center of the bottom portion 21 protrudes upward. Erected around the edge of the protruding center is a partition 22 which defines a recess in which the lower portion of the crank housing 7 is fitted. As also shown in FIG. 3, the baffle plate 20 additionally includes a flange 23 which extends substantially radially from the upper edge of the partition 22 at right angles to the axis of the motor shaft 6. The flange 23 reaches the inner surface of the motor housing 3, except where bosses 26 for receiving screws to secure the motor housing 3 to the barrel 2 and the handle housing 5 are disposed. The frontmost right and left portions of the flange 23 are in contact with the respective frontmost screw bosses 26. A circular slot 24 is formed at the front peripheral surface of the protruding center of the bottom portion 21. Furthermore, the baffle plate 20 includes an inclined plate 25 which extends forwardly and upwardly from the lower edge of the circular slot 24, reaching a front wall 3*a* on the inner surface of the motor housing 3.

A plurality of air inlets 27 are provided in the handle housing 5 directly behind the barrel 2, whereas a cooling fan 28 is fitted on the bottom end of the shaft 6 of the motor 4. In addition, a plurality of air outlets 29 are provided in the bottom of the motor housing 3 immediately outside the cooling fan 28.

In the operation of the hammer drill 1 thus constructed, when the motor 4 is activated to rotate the motor shaft 6, as described above, the crank shaft 9 causes the piston 11 to make reciprocating motion, thus transmitting hammer blows to the tool bit attached to the top end of the hammer drill 1. In addition, the operator can set the hammer drill 1 in one of several operating modes, including a striking mode and a hammer-plus-rotation mode, by operating the change-over lever to allow or prevent rotation of the intermediate shaft 17.

When the cooling fan 28 is rotated by the rotation of the motor shaft 6, external air is drawn into the hammer drill 1 through the air inlets 27. The inside of the motor accommodating chamber 19 is in pneumatic communication with that of barrel 2 only through the slot 24 due to the baffle plate 20. Therefore, as indicated by broken-line arrows in FIG. 1, the airflow created by the cooling fan 28 is guided by the flange 23 along the outside of the crank housing 7 and the gear housing 8 to the barrel 2. The airflow then goes around the front ends of the flange 23 and enters the motor accommodating chamber 19 at the slot 24. Once entering the chamber 19, the airflow moves along the motor 4 and passes between the blades of the fan 28, subsequently exiting the hammer drill 1 through the air outlets 29.

As described above, the foregoing embodiment defines an extension air passage 30 that allows fan-drawn air to flow around the flange 23 upstream of the motor 4 as the air passes through the barrel 2 before passing through the motor housing 3. The air that flows along the extension air passage 30 not only cools the motor 4 but also the striking and rotary mechanisms, including the cylinder 10. This allows the operator to hold the barrel 2 without feeling the discomfort caused by excessive heat, thus enhancing the operability of the hammer drill 1. Moreover, as the air inlets 27 are provided directly behind the barrel 2 and the air outlets 29 are provided in the bottom surface of the motor housing 3, almost no dust enters the hammer drill 1 when the top end of the drill 1 is held upward during operation, thus providing effective dust protection for drill structures, such as the barrel 2, the motor housing 3, and the handle housing 5.

In this embodiment, the baffle plate 20 provided with the flange 23 serves as the structure for closing the opening of the motor accommodating chamber 19; however, any other suitable structure, such as one or more ribs provided on the outer surface of the crank housing 7 or the gear housing 8, or on the inner surface of the barrel 2 or the handle housing 5, may be configured as such a closing structure.

Effect of the Invention

According to the invention, both the striking mechanism and the motor are cooled by airflow drawn by the motor due to the structure for closing the opening of the motor accommodating chamber as well as the position of the air inlets. This allows the operator to hold the barrel 2 without feeling the discomfort caused by excessive heat, thus enhancing the operability of the hammer drill.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. A power-driven striking tool having front and rear portions, comprising:

a main housing containing a striking mechanism for transmitting hammer blows to a tool bit attached to said front portion;

a motor housing connected to the main housing, the motor housing containing a motor having a motor shaft on which a fan is provided, wherein the fan, when rotated by the motor, creates an airflow through the motor housing;

at least one air inlet provided in the rear of the main housing for admitting said airflow;

a closing member extending in front and rear directions for isolating the motor from the main housing; and an air gate configured to allow the airflow to enter the motor housing after passing over a front end of the closing member and through at least a portion of the main housing, thus cooling the striking mechanism.

2. A power-driven striking tool in accordance with claim 1, wherein the closing member includes the air gate and the closing structure is a baffle plate including a bottom portion which pneumatically separates the motor housing from the main housing except at the air gate, the air gate being provided in a front end of the bottom portion, and further wherein the baffle plate further includes a flange along which the airflow is guided into the main housing toward the air gate.

3. A power-driven striking tool in accordance with claim 2, wherein the flange includes a front end which is distal to the at least one air inlet and proximal to said front portion of the striking tool, and the flange further includes a rear end proximal to the at least one air inlet and distal to said front portion of the striking tool, the front end being located forward of the air gate such that external air drawn into the tool through the air inlet travels over the flange and around the front end of the baffle plate and enters the motor housing at the air gate.

4. A power-driven striking tool in accordance with claim 3, wherein the fan is fitted on the motor shaft in close proximity to a bottom of the motor housing, and further wherein at least one air outlet is provided in the bottom of the motor housing, whereby rotation of the motor draws in external air though the at least one air inlet and discharges the air through the at least one air outlet via the main housing and the motor housing.

5. A power-driven striking tool in accordance with claim 2, wherein the baffle plate further includes a recess in which a portion of the striking mechanism is fitted.

6. A power-driven striking tool in accordance with claim 1, wherein the motor housing is connected to the main housing such that an axis of the motor housing is oriented at right angles to an axis of the main housing.

7. A power-driven striking tool in accordance with claim 6, wherein the motor housing contains a substantially cylindrical inner housing for containing the motor, the inner housing having a substantially circular opening in which the bottom portion of the baffle plate is fitted to close the opening and the inner housing further having a peripheral wall.

8. A power-driven striking tool in accordance with claim 7, wherein the inner housing is located intermediately between the front and rear ends of the flange such that the airflow is oriented back toward the at least one inlet as the airflow enters the inner housing.

9. A power-driven striking tool in accordance with claim 7, wherein the air gate is a circular slot concentric with the peripheral wall of the inner housing.

10. A power-driven striking tool in accordance with claim 9, wherein the baffle plate further includes an inclined plate extending from a lower edge of the circular slot and reaches the motor housing so as to guide the airflow into the inner housing.

11. A power-driven striking tool in accordance with claim 1 further comprising a handle housing provided in the rear of the main housing and the motor housing, the at least one air inlet being provided in the handle housing directly in the rear of the main housing.

12. A power-driven striking tool having front and rear portions, comprising:

a main housing containing a striking mechanism for transmitting hammer blows to a tool bit attached to said front portion;

a motor housing connected to the main housing such that an axis of the motor housing is oriented at right angles to an axis of the main housing, the motor housing containing a motor having a motor shaft on which a fan is provided, wherein the fan, when rotated by the motor, creates an airflow through the motor housing;

at least one air inlet provided in the rear of the main housing for admitting said airflow;

a closing member extending in front and rear directions for isolating the motor from the main housing; and an air gate configured to allow the airflow to enter the motor housing after passing over a front end of the closing member and through at least a portion of the main housing, thus cooling the striking mechanism.

* * * * *

UNITED STATES PATENT AND TRADEMARK OFFICE

CERTIFICATE OF CORRECTION

PATENT NO. : 6,325,157 B1 
DATED : December 4, 2001
INVENTOR(S) : Takuo Arakawa and Koki Hyodo It is certified that error appears in the above-identified patent and that said Letters Patent is hereby corrected as shown below:

Column 5,
Line 53, replace "structure" with -- member --.

Signed and Sealed this

Thirteenth Day of August, 2002

*Attest:*

*Attesting Officer*

JAMES E. ROGAN
*Director of the United States Patent and Trademark Office*